US005117974A

United States Patent [19]

Bieber

[11] Patent Number: 5,117,974

[45] Date of Patent: Jun. 2, 1992

[54] HANGER SUPPORT FOR GARMENT BAG

[75] Inventor: David Bieber, East Greenwich, R.I.

[73] Assignee: American Tourister, Inc., Warren, R.I.

[21] Appl. No.: 743,444

[22] Filed: Aug. 9, 1991

[51] Int. Cl.[5] ..... A45C 13/26

[52] U.S. Cl. ..... 206/278; 206/287.1

[58] Field of Search ..... 190/100, 115; 206/278, 206/278.1, 279, 284–287, 287.1, 288–291

[56] References Cited

U.S. PATENT DOCUMENTS 2,481,102 9/1949 Frost ..... 206/285
3,512,621 5/1970 Teetor ..... 206/287
3,743,083 7/1973 James ..... 206/287
4,927,014 5/1990 Pulichino, Jr. ..... 206/287.1

*Primary Examiner*—Jimmy G. Foster
*Attorney, Agent, or Firm*—Wood, Herron & Evans

[57] ABSTRACT

A garment bag having a primary compartment and a front panel hinged to the primary compartment along a vertical edge. The compartment section has a hanging hook at the center of its upper edge. The panel has a hanging hook on its upper edge located between the center of the upper edge and the outer free edge. The garment bag is hung by the two hanging hooks on the upper edge of a door. The panel hanging hook prevents drooping of the panel when the garment bag is hung on a door.

1 Claim, 1 Drawing Sheet

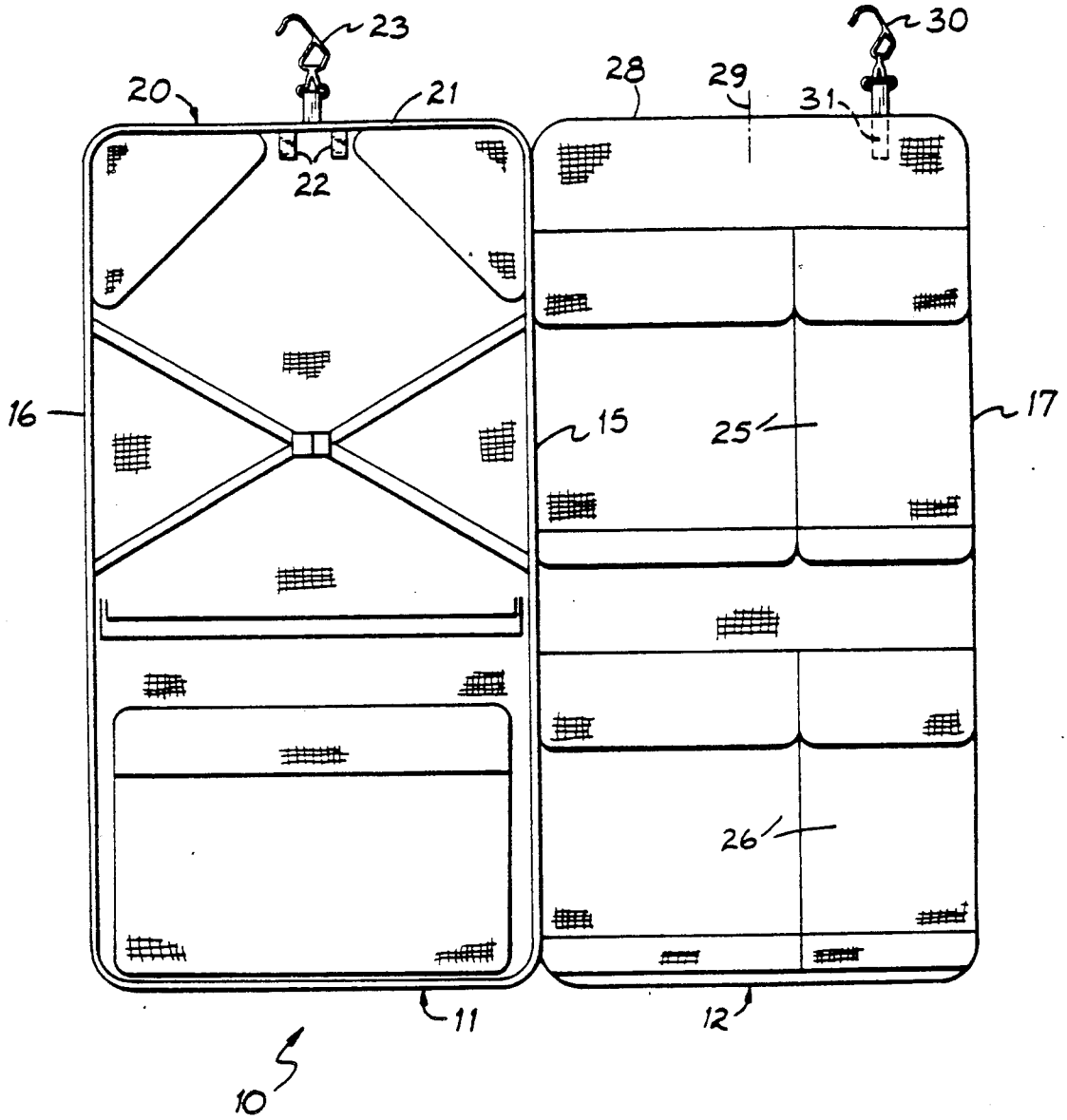
23
30
20
21
28
29
31
22
16
15
25
17
26
11
12
10

HANGER SUPPORT FOR GARMENT BAG

This invention relates to a garment bag and more particularly to the hanging hooks for a garment bag.

The garment bag is of the type disclosed in U.S. Pat. No. 4,927,014 which is fully incorporated herein by reference. The garment bag is generally rectangular in configuration. The bag has a primary compartment and a front panel hinged to one side of the primary compartment. A slide fastener is used to attach the free edges of the front panel to the primary compartment to close the garment bag. When the bag is filled, it is closed and folded upon itself to form a compact carrying bag.

When open, the bag is normally hung on a door so that it can be conveniently filled or, alternatively, so that articles packed in it can be conveniently removed. To hang the bag on a door, each of the garment bag and front panel has a hanging hook attached to the center of its upper edge. The hanging hooks are mounted on the top edge of the door. The primary compartment is normally reinforced across the top edge and provided internally with a hanger bracket for mounting suits or dresses on hangers in the primary compartment. The front panel, while having upper and lower compartments for thin articles, has no internal stiffening. As a consequence, its outboard edge droops when hung on a door, making somewhat awkward the packing or unpacking of the limited number of pockets on the front panel.

An objective of the present invention is to improve the hanging capability of the garment bag.

The objective of the invention is attained by mounting the hanging hook on the front panel approximately midway between the center of the top edge of the panel and the outboard free edge of the front panel. The shifting of the hanging hook toward the outboard edge of the front panel solves a vexing problem of panel droop in a simple and inexpensive way.

BRIEF DESCRIPTION OF THE DRAWING

The objective and features of the invention will become more readily apparent from the following detailed description taken in conjunction with the accompanying drawing which is a diagrammatic, elevational view of a garment bag, in open condition, in accordance with the present invention.

DETAILED DESCRIPTION OF THE INVENTION

Referring to the drawing, a garment bag 10 has a primary compartment 11 and a front panel 12. The front panel 12 is hinged to the primary compartment along a fabric hinge line 15. The primary compartment has a free edge 16 and the front panel has a free edge 17, the free edges having a slide fastener mechanism for closing the garment bag when the front panel is swung over the primary compartment to close the bag. The free edge 16 of the primary compartment includes an upper edge 20. The upper edge has a depth of approximately three inches which is internally-reinforced with a reinforcing bar 21. Clothes hanger brackets 22 are provided for garments such as suits or dresses. A hanging hook 23, suitable for supporting the primary compartment on the upper edge of the door, is secured to the top edge 20 of the primary compartment.

The front panel 12 is simply a fabric to which upper pockets 25 and lower pockets 26 have been stitched. The panel 12 has no stiffening means.

The free edge 17 includes an upper edge 28 which has a center indicated at 29. That is where the hanging hook normally has been attached. In accordance with the present invention, a hanging hook 30 is sewn by means of an internal strap 31 to the upper edge 28 of the front panel 12. The hanging hook 30 is located outboard of the center 29 of the panel 12, and more particularly, approximately midway between the center 29 and the vertical portion of the free edge 17.

When the bag is open and hung on a door with the primary compartment hanging hook 23 and the front panel hanging hook 30 hung on the door, the bag has a very stable support system and the tendency of the front panel to droop is eliminated.

From the above disclosure of the general principles of the present invention and the preceding detailed description of a preferred embodiment, those skilled in the art will readily comprehend the various modifications to which the present invention is susceptible. Therefore, I desire to be limited only by the scope of the following claims and equivalents thereof:

I claim:

1. A garment bag comprising:

a primary compartment having two side edges and a first upper edge, hook mounted in the center portion a hanging of said first upper edge, a front panel having a top edge and two side edges, one side edge of said compartment and panel being hinged to each other, the other side edges being free and having slide fastener means for removably joining them to close said garment bag, and a second hanging hook mounted on said top edge of said front panel and positioned approximately midway between the center of said top edge and the free edge of said front panel whereby to hang said front panel while minimizing drooping of said free edge.

* * * * *

UNITED STATES PATENT AND TRADEMARK OFFICE

CERTIFICATE OF CORRECTION

PATENT NO. : 5,117,974

DATED : June 2, 1992

INVENTOR(S) : David Bieber

It is certified that error appears in the above-indentified patent and that said Letters Patent is hereby corrected as shown below:

Column 2, lines 41-42, "hook mounted in the center portion a hanging of said first upper edge," should read --a hanging hook mounted in the center portion of said first upper edge,--.

Signed and Sealed this

First Day of March, 1994

Bruce Lehman

*Attest:*

BRUCE LEHMAN

*Attesting Officer*

*Commissioner of Patents and Trademarks*